US005284272A

United States Patent [19]

Wei

[11] Patent Number: 5,284,272

[45] Date of Patent: Feb. 8, 1994

[54] MULTIPURPOSE BOTTLE AND CAP WITH MASSAGING DEVICES

[75] Inventor: Winston S. T. Wei, Singapore, Singapore

[73] Assignee: Multiscience System Pte. Ltd., Singapore, Singapore

[21] Appl. No.: 963,071

[22] Filed: Oct. 19, 1992

[51] Int. Cl.[5] ..... A61H 7/00

[52] U.S. Cl. ..... 222/192; 222/212; 222/521; 128/60; 128/67

[58] Field of Search ..... 128/60, 61, 64, 67; 222/192, 212, 215, 520, 521, 524, 525

[56] References Cited

U.S. PATENT DOCUMENTS

| | | | |
|---|---|---|---|
| 1,443,269 | 1/1923 | Linden | 128/60 X |
| 2,084,529 | 6/1937 | Landau | 128/60 X |
| 2,582,026 | 1/1952 | Friedman | 222/525 X |
| 2,584,735 | 2/1952 | Pancoast | 128/67 X |
| 2,944,273 | 7/1960 | Harris | 128/60 X |
| 3,599,845 | 8/1971 | Miller | 222/525 |
| 4,681,095 | 7/1987 | Bontemps | 128/67 X |
| 4,767,034 | 8/1988 | Cramer | 222/525 |
| 4,805,807 | 2/1989 | Perne et al. | 222/212 X |

FOREIGN PATENT DOCUMENTS

| | | | |
|---|---|---|---|
| 0296103 | 12/1988 | European Pat. Off. | 222/525 |
| 3829969 | 11/1989 | Fed. Rep. of Germany | 222/524 |
| 1255584 | 12/1971 | United Kingdom | 222/521 |

*Primary Examiner*—David M. Mitchell
*Assistant Examiner*—Anthoula Pomrening
*Attorney, Agent, or Firm*—Raymond Sun

[57] ABSTRACT

A multipurpose bottle and cap combination comprises a bottle for containing a fluid, a neck with an opening through which the fluid may flow, and a bottom. A cap is secured to the neck of the bottle by threaded engagement, and controls the flow of the fluid through the cap. A first massaging device comprising a plurality of curved surfaces terminating in a tip are provided on the cap, and a second massaging device comprising a plurality of rounded protrusions are spaced apart on the bottom of the bottle.

12 Claims, 4 Drawing Sheets

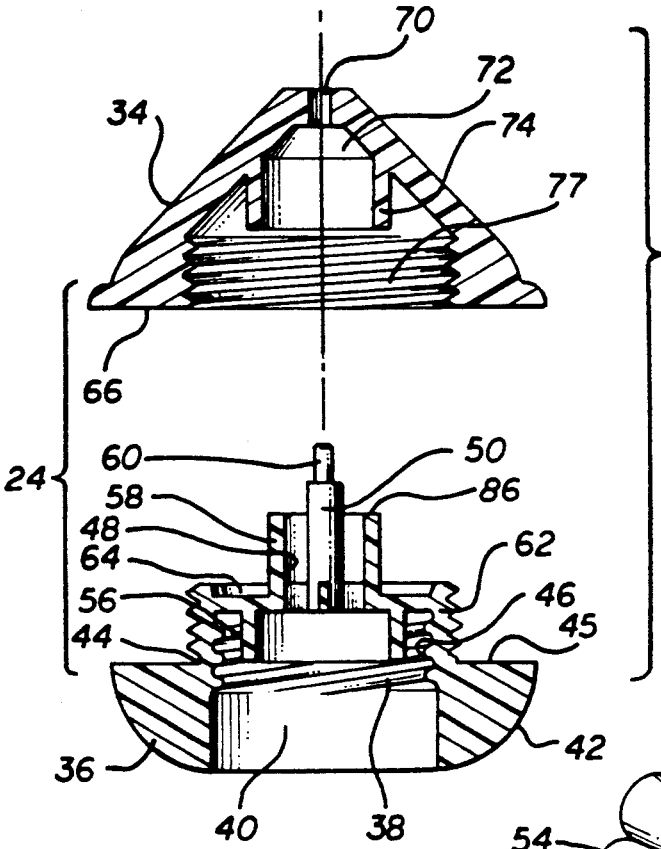
FIG. 5
FIG. 6
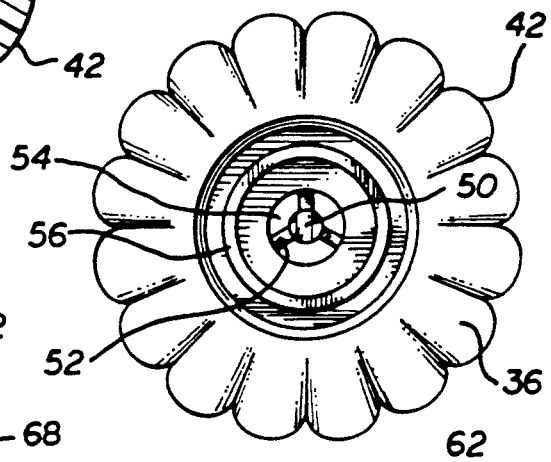
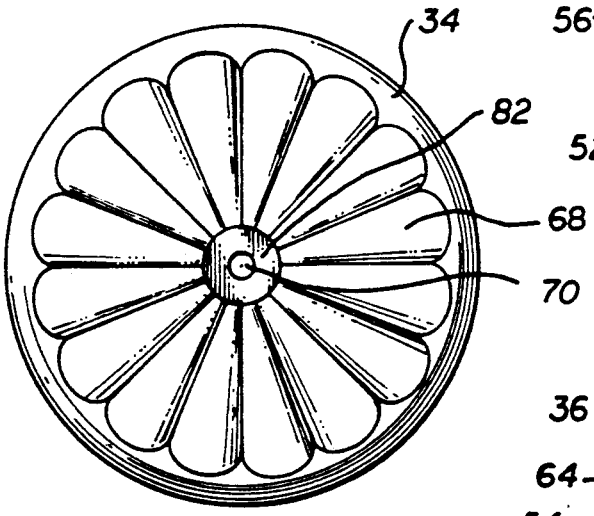
FIG. 7
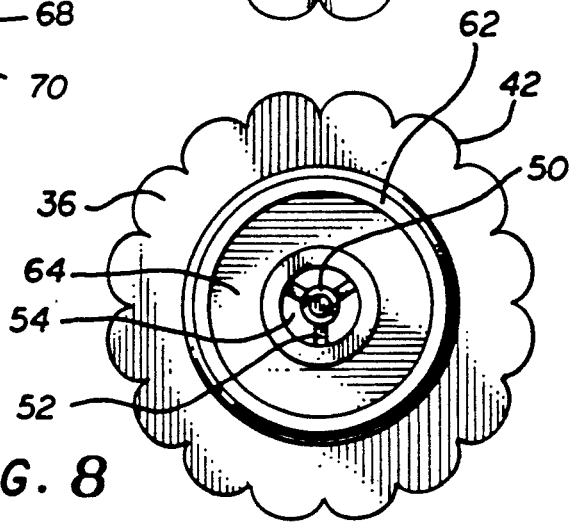
FIG. 8

FIG. 9
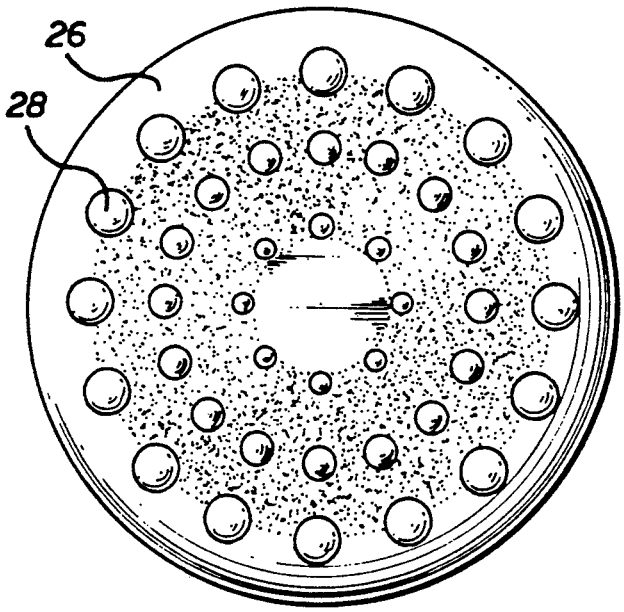
FIG. 10
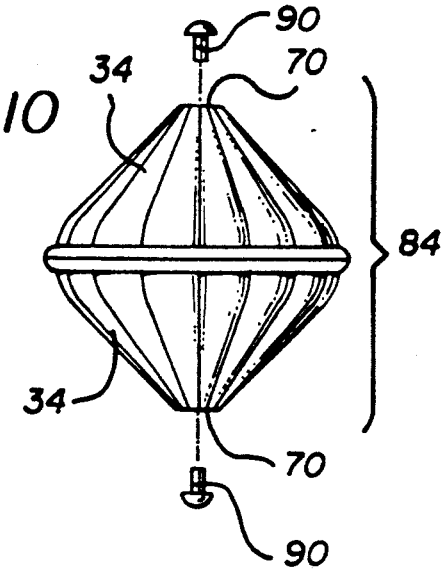
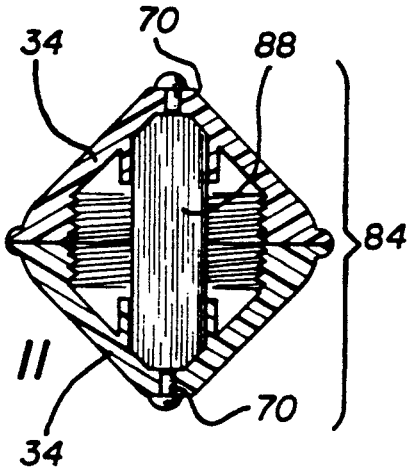
FIG. 11
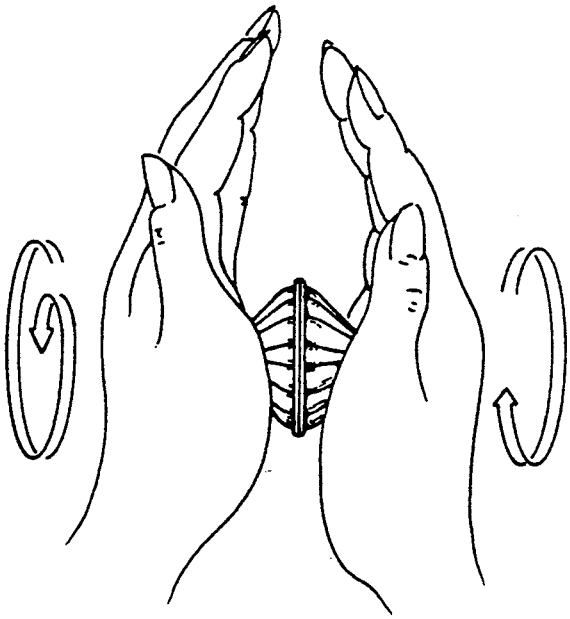
FIG. 12
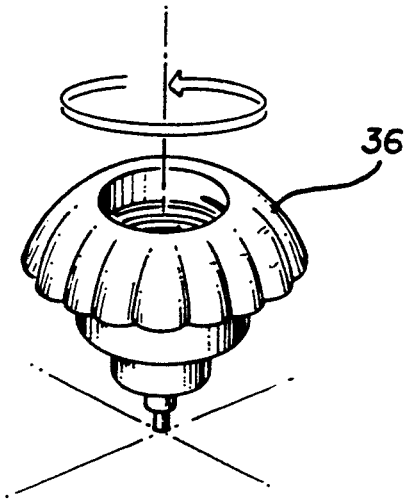
FIG. 13

MULTIPURPOSE BOTTLE AND CAP WITH MASSAGING DEVICES

BACKGROUND OF THE INVENTION

1. Field Of The Invention

The present invention relates to a multipurpose bottle and cap combination which may be used to contain perfume, powder, cosmetic products, medicines or other aromatic fluids and which is provided with at least two different types of massaging devices which may be used to effect at least two different types of massages.

2. Description Of The Related Art

There are currently bottles which are made specifically for containing powder, perfume or other aromatic fluids, such as air refreshener and cologne bottles. Many of these bottles are made of different shapes to provide the desired aesthetic appeal, and are also made from different materials; for example, plastic, glass, or crystals. However, all of these bottles are only made specifically for containing such powder and fluids. An individual may often times wish to carry these bottles in a bag for use in public places, and often finds such bottles to be quite bulky and, in some cases, heavy. Depending on the shape of the bottle which is often designed for aesthetic appeal and not to provide stability, the bottle may be unstable and may topple when resting on a flat surface. Further, the caps of such bottles are not always tightly secured so that the powder, perfume or fluid may leak or escape from the bottle.

There are a number of ways of performing acupressure massage. Such massages are most commonly given by masseurs or masseuses, who administer acupressure massage by using their fingertips to apply appropriate pressure to the localized pressure points in a person's body. Such application of pressure creates a warmth which is converted into a minute electrical charge. This charge feeds the muscles, nerves and lymphatic system and clears the meridians that are blocked. This increases blood and energy circulation between these pressure points. However, the masseur must accurately exert sufficient pressure on the pressure points via his or her fingertips to stimulate the pressure points to achieve a soothing and comfortable massage. Moreover, most masseurs accompany the massage with the application of powder, oils, or other lotion, many of which contain a pleasing and soothing aroma.

Massages may also be administered manually by an individual through the use of massaging devices. There are currently massaging devices which may be carried by an individual for use. For example, a round stick with a short handle is often used. The stick is often blunt and imprecise for applying the needed and accurate pressure. Such a device cannot create a wave pattern on the skin to achieve a soothing massage. In addition, some of these massaging devices are not provided with proper handles so that the individual often has difficulty firmly gripping the device when administering the massage. Moreover, it is often desirable that the massage be accompanied by a soothing aroma such as that emitted by perfume or herbal fluids.

Thus, there is a need for a bottle and cap combination which an individual may conveniently carry with him or her, the bottle capable of containing and effectively sealing powder, perfume or aromatic fluids and having a plurality of massaging devices provided thereon to effectuate different forms of massage.

SUMMARY OF THE INVENTION

The objects of the present invention may be achieved by providing a multipurpose bottle and cap combination comprising a bottle for containing fluid or powdered contents, a neck with an opening through which the contents may flow, and a bottom. A cap is secured to the neck of the bottle by threaded engagement, and has means for controlling the flow of the fluid through the cap. First massaging means comprising a plurality of curved surfaces terminating in a tip are provided on the cap, and second massaging means comprising a plurality of rounded protrusions are spaced apart on the bottom of the bottle.

The multipurpose bottle and cap combination according to the present invention provides a bottle which may be used to contain powder, cosmetic products, perfume, aromatic fluids or medicine, and a cap fitted with a locking mechanism which provides a tight seal of the fluid contents. The bottle and cap combination may also be used as an air refreshener. The rounded shape of the bottom of the bottle provides an aesthetically pleasing appearance yet has a low center of gravity for better stability to prevent the bottle from toppling.

The cap itself is designed with a pointed tip which may be used to simulate needle acupuncture at localized pressure points. The pointed tip allows pressure to be accurately applied to the pressure points, and is made of hard material to ensure that sufficient pressure is applied. The bottom of the bottle is provided with a plurality of rounded protrusions which may be used for normal to light massaging for outer skin dermis and may also be used to aid in the removal of dead skin cells. The widened round shape of the bottle also allows the individual to comfortably grip the bottle and point the tip of the cap at the appropriate pressure points to apply the required massaging pressure. Thus, the bottle and cap combination according to the present invention provides at least two massaging devices for at least two different types of massage and allows an individual to accompany the massage with a pleasing fragrance or aroma emitted by the contents contained in the bottle. The massaging devices may be used to massage an individual's face and entire body.

Two of the caps according to the present invention may also be combined to form a massaging ball which may be used for full-body massage and may also be held between the hands and rotated therebetween to massage the individual's hands.

BRIEF DESCRIPTION OF THE DRAWINGS

FIG. 5 is an exploded cross-sectional view of the upper and lower parts of the cap of FIG. 1;

FIG. 6 is a bottom-plan view of the lower part of the cap of FIG. 5;

FIG. 7 is a top-plan view of the upper part of the cap of FIG. 5;

FIG. 8 is a top-plan view of the lower part of the cap of FIG. 5;

FIG. 9 is a bottom-plan view of the bottle of FIG. 1;

FIG. 10 is a perspective view of a massaging ball formed by combining two of the upper parts of the cap of FIG. 5;

FIG. 11 is a cross-sectional view of the massaging ball of FIG. 10 with strands of fibers contained therein;

FIG. 12 shows how the massaging ball of FIG. 12 may be rotated between the palms of an individual's hands; and FIG. 13 shows how the lower part of the cap of FIG. 5 may be spun as a spinning toy.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
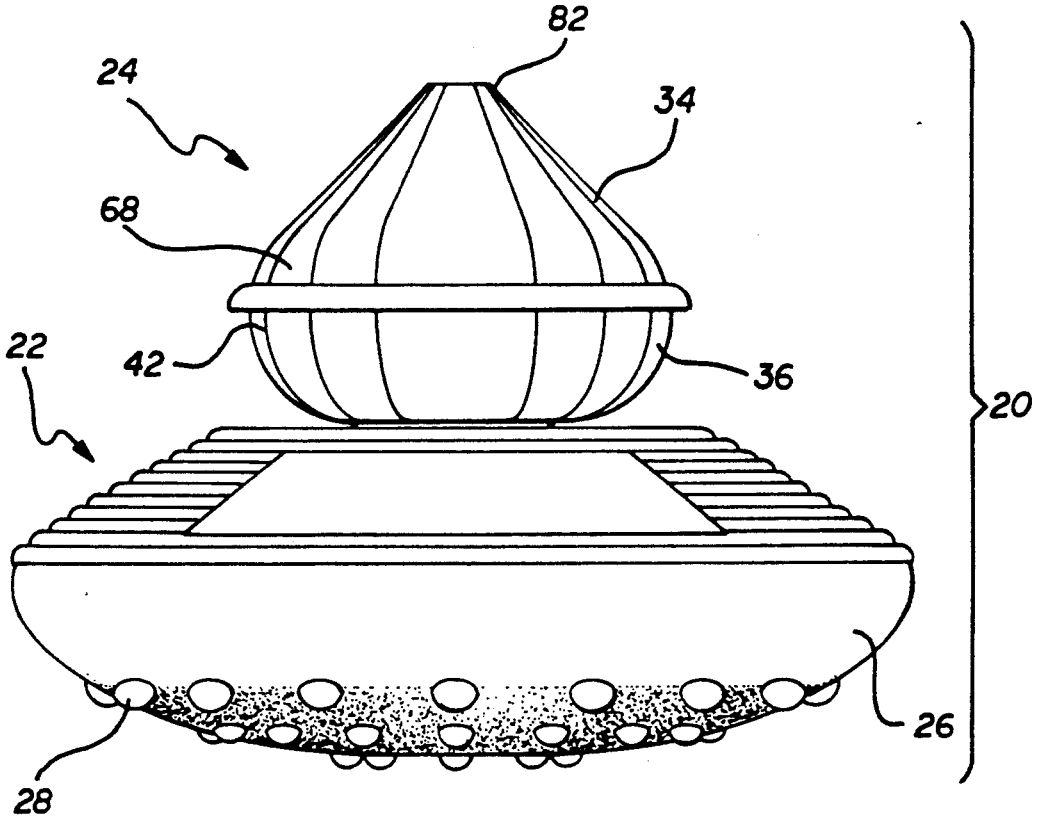
FIG. 1 is a side view of a bottle and cap combination in accordance with an exemplary embodiment of the present invention.
Figure 2:
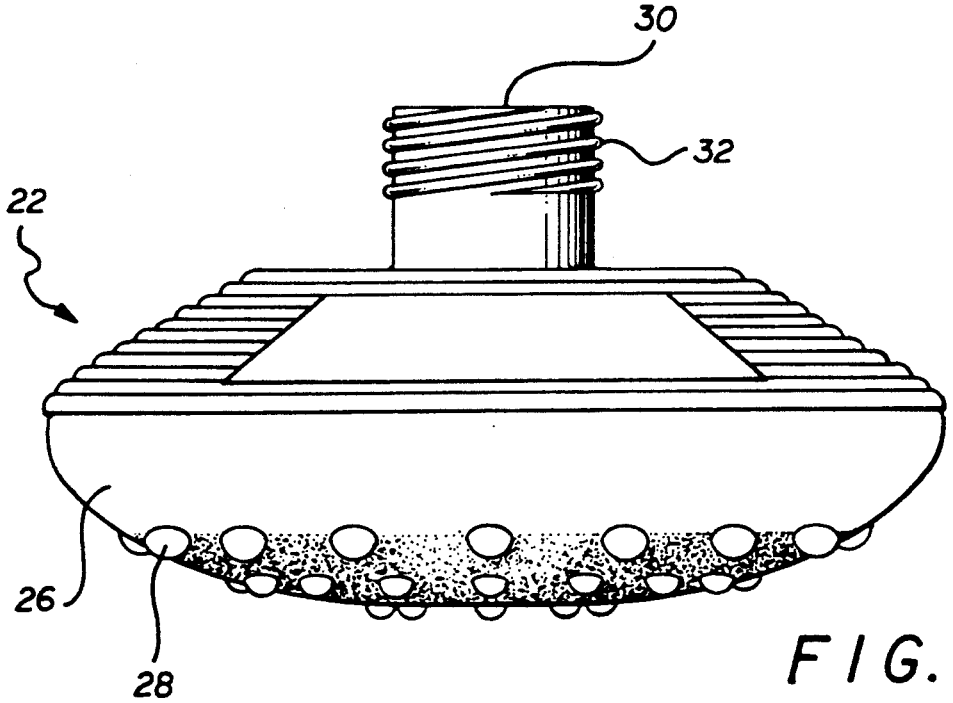
FIG. 2 is side view of the bottle of FIG. 1.
Figure 3:
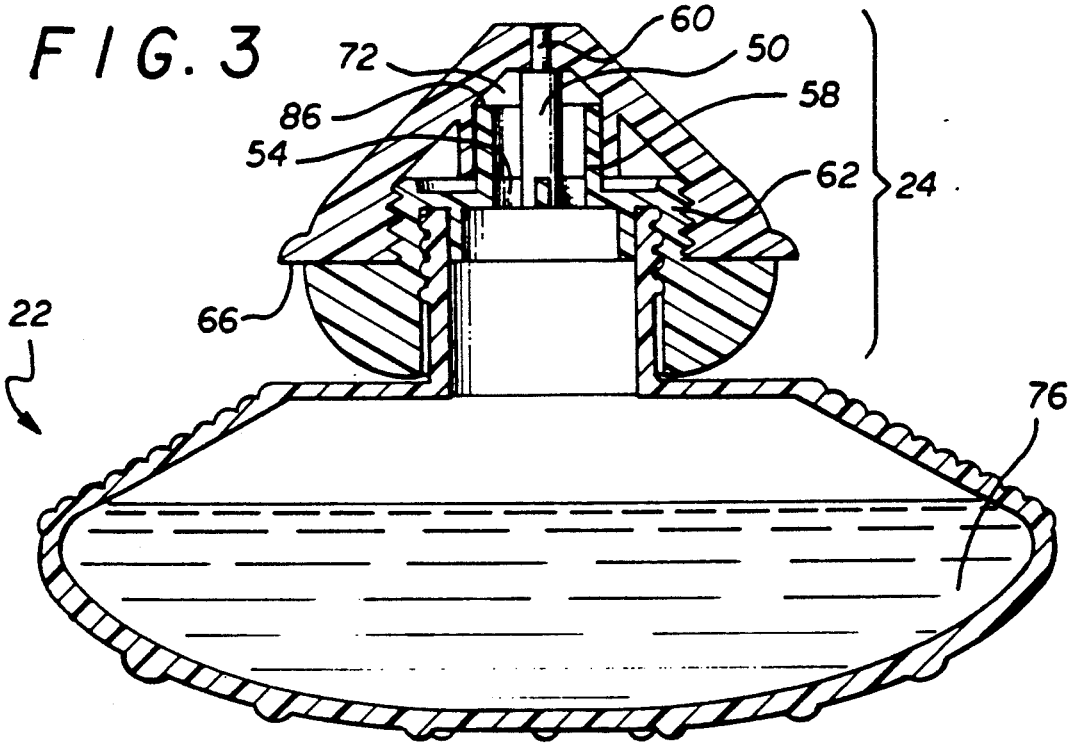
FIG. 3 is a cross-sectional view of the bottle and cap combination of FIG. 1 with the cap in a closed position.

Referring to the Figures, the bottle and cap combination 20 in accordance with a preferred embodiment of the present invention comprises a bottle 22 with a cap 24 secured thereupon. Referring to FIGS. 1 and 2, the bottle 22 has a rounded shape with its diameter being widest near its bottom 26 to provide a low center of gravity to the bottle 22 to prevent it from toppling. In the preferred embodiment, a fluid 76 is described as being contained in the bottle 22, but it will be appreciated by those skilled in the art that a powdered substance can also be contained in the bottle 22 and caused to flow through the cap 24 as described hereinbelow. A plurality of rounded protrusions 28 are provided in spaced-apart relation on the bottom 26, as shown more clearly in FIG. 9 and explained in greater detail hereinbelow.

The cap 24 is secured to the neck 30 of the bottle 22. Referring to FIGS. 3-8, the cap 24 is comprised of an upper part 34 and a lower part 36. The lower part 36 has a substantially circular configuration with curved edges 42 along its circumference, as better illustrated in FIGS. 1, 6 and 8. The lower part 36 is also formed with an annular shoulder 44 whose vertical wall 46 defines a central bore 40 within the interior of the lower part 36. Threads 38 are formed in the inner surfaces of the bore 40 to engage the threads 32 of the neck 30 to secure the lower part 36 of the cap 24 to the bottle 22. The bore 40 is opened at the bottom for fluid communication with the mouth of the bottle neck 30 and is provided with an opening 48 at the top thereof. A shaft 50 is fitted within the opening 48 and has three spokes 52 extending from the shaft 50 and connected to the walls of the opening 48 to define three small apertures 54 through which fluid may flow. An annular flange 56 is sized and configured at the top of the central bore 40 about the opening 48 to fit directly within the circumferential edge of the mouth of the neck 30 to guide fluid from the bottle 22 through the apertures 54 and into a channel 58. The shaft 50 extends through the channel 58 and is provided with a narrowed tip 60 at its upper end which has a smaller diameter than the shaft 50.

Referring to FIGS. 1, 3, 4, 5 and 7, the upper part 34 of the cap 24 has a substantially hollow interior, and also has a circular configuration and is provided with an annular flat surface 66 which is adapted to be seated on the horizontal surface 45 of the shoulder 44 when the cap 24 is in the closed position. The external surface of the upper part 34 is comprised of curved surfaces 68, as better illustrated in FIGS. 1 and 7 and explained in greater detail hereinbelow. An opening 70 is provided at the uppermost tip of the upper part 34. The opening 70 communicates with a bore 72 defined in the interior of the upper part 34 by annular wall 74.

Referring to FIG. 5, the upper part 34 is fitted over and secured to the lower part 36 by inserting the upper part 34 over the lower part 36 such that the annular wall of the channel 58 is fitted into the bore 72, with the vertical wall 46 of the shoulder 44 fitted into the hollow interior of the upper part 34. The fitting of the vertical wall 46 into the interior of the upper part 34 is a tight fit, and those skilled in the art will appreciate that threads may also be provided along the vertical wall 46 for threadable engagement with internal threads 77 formed on the interior surfaces of the upper part 34.

To create a tight seal in the cap 24 so that the fluid in the bottle 22 does not escape, the upper part 34 and the lower part 36 are fitted together as described above, but the annular flat surface 66 is seated firmly on the annular horizontal surface 45 of the shoulder 44. In this closed position (see FIG. 3), the top circumferential edge 86 of the channel 58 abuts against the inner walls of the bore 72 and the tip 60 extends through the opening 70 in the upper part 34 to form a seal. The abutment of the top circumferential edge 86 of the channel 58 against the inner walls of the bore 72 creates a tight seal so that fluids or powder passing through the three apertures 54 are trapped in bore 72 and cannot escape to the shoulder 44.

Figure 4:
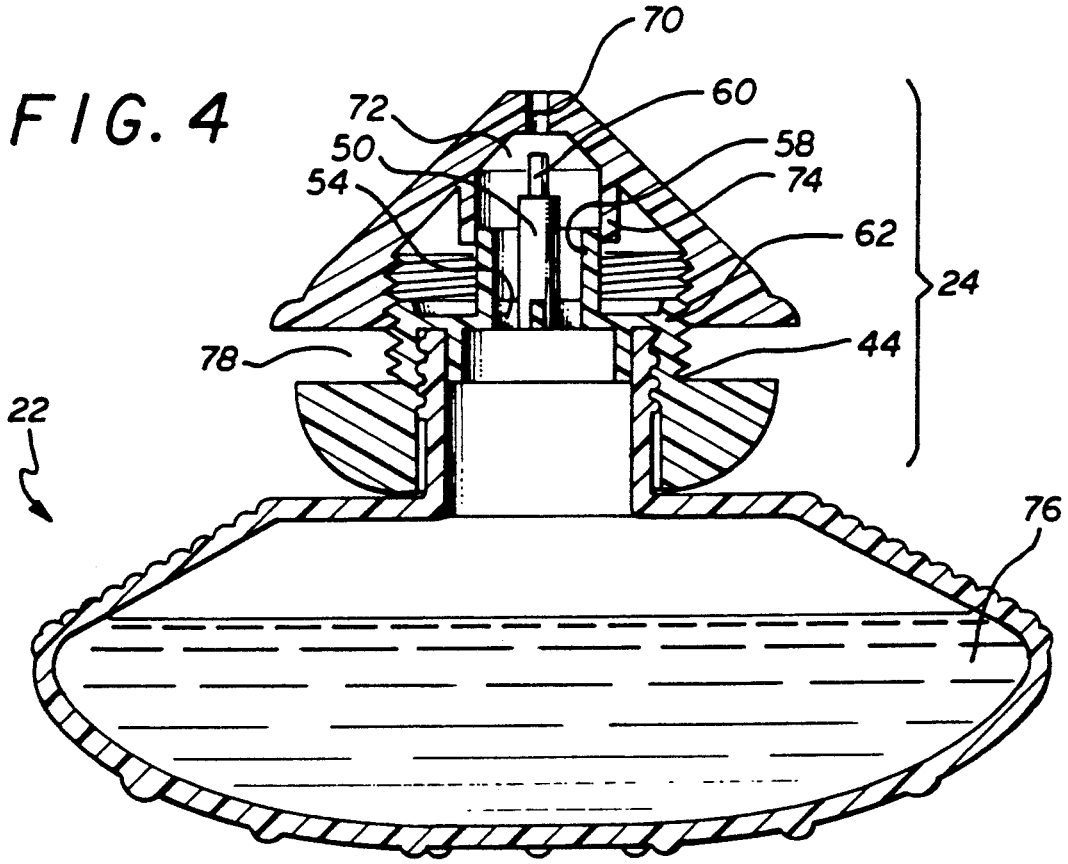
FIG. 4 is a cross-sectional view of the bottle and cap combination of FIG. 1 with the cap in an opened position.

To allow fluid to be released from the bottle 22, the upper part 34 is lifted from the bottom part 36, as illustrated in FIG. 4. The bottle 22 is then turned over to allow the fluid 76 to flow through the neck 30 and the three apertures 54 into the bore 72. Since the tip 60 does not extend through the opening 70 in this opened position, the fluid 76 in bore 72 may flow through the opening 70. The wall of the channel 58 still slides within the bore 72 to prevent fluid 76 from escaping outwardly through side openings 78. An annular upturn 62 is formed about the circumference of the upper part of the shoulder 44 to form a well 64 for collecting fluid 76 that does escape from the bore 72. The shape of the bottle 22 also allows the individual to push out controlled amounts of fluid 76 from the bottle 22 by using the thumb to exert a slight pressure at the bottom 26 of the bottle 22 with the neck 30 of the bottle 22 held by the middle and index fingers.

The bottle and cap combination 20 according to the present invention therefore provides a bottle for containing powdered substance or a fluid 76, which may be perfume, medicine or other aromatic fluids. The engagement of the upper and lower parts 34 and 36 of the cap 24 provides a tight seal to prevent leakage of the powder o the fluid 76. The bottle and cap combination 20 may also be used as an air refreshener by turning the cap 24 to its opened position as shown in FIG. 4, so that the fragrance may escape through the opening 70.

The upper part 34 of the cap 24 may be used to effect a particular form of massage. Referring to FIGS. 1 and 7, the curved surfaces 68 lead to a pointed tip 82 at the uppermost end. The pointed tip 82 simulates needle acupuncture at localized pressure points in that it replaces the fingertip of a masseur and is therefore more accurate and exerts higher pressure to cause the necessary acupuncture stimulation. The curved surfaces 68 are thicker and broader at the bottom and thinner and sharper at the tip 82 so as to support higher pressure and not deform during the massage. The curved surfaces 68 create a wave pattern on the skin during the massage, and reduce the friction of the cap 24 on the body during a massage to allow the tip 82 to be rotated, as explained below, with a substantially constant speed and pressure. The cap 24 is made from a plastic material, and preferably high density polypropylene, although it will be appreciated by those skilled in the art that other materials may be used without departing from the spirit and scope of the present invention. The material of the cap 24 is preferably harder than the material used for the bottle 22.

In use, the individual may grip the bottle 22 about its widened bottom 26 and rotate the tip 82 at specific points all over the face and the body to effect high pressure acupressure. Thus, the individual may grip the bottle 22 as a handle while using the cap 24 as a massaging device. Alternatively, the cap 24 and its upper part 34 may be removed from the bottle 22 and a handle (not shown) may be screwed onto the upper part 34 for use.

The bottom 26 of the bottle 22 has a plurality of rounded protrusions 28 which may be used to effect another form of massage. Referring to FIGS. 1 and 9, the protrusions 28 are spaced apart over the bottom 26. In use, an individual may grip the cap 24 and rotate the bottom 26 around its central axis over his or her body and/or face to create a soothing feeling to the skin, or may be rubbed against the skin to create a stronger feeling. Alternatively, the bottom 26 can be rubbed throughout the body during a bath. The protrusions 28 on the bottom 26 are used for normal to light massaging for outer skin dermis and to remove dead skin cells when the appropriate lotion or cream is applied thereto, and not for high pressure massage. The spacings between the protrusions 28 facilitate the soothing feeling. The inner protrusions are smaller than the outer protrusions because they are closer to the target point, while the outer protrusions are larger because they are further from the target point. The bottle 22 and its bottom 26 are made from plastic, glass, crystal or metal, and preferably a plastic material, although it will be appreciated by those skilled in the art that other materials may be used without departing from the spirit and scope of the present invention. This material is preferably softer than the material used for the cap 24.

Thus, the cap 24 and bottom 26 operate as different massaging devices, but both can be used to cause a localized hyperaemia on the skin area which activates underlying blood circulation through the pressure points, which will accelerate the rejuvenation rate of skin in its renewal process.

The bottle and cap combination 20 of the present invention may also be used for a number of other applications. First, this combination may be used as a water gun toy in which the bottle 22 contains water. The bottle 22 may be gripped as described above and the water squirted through the cap 24 at a target.

Second, two identical upper parts 34 may be attached to form a massaging ball 84 as shown in FIGS. 10 and 11. Attachment of the two upper parts 34 is accomplished by chemical or heat bonding, although it will be appreciated by those skilled in the art that other attachment means may be used without departing from the spirit and scope of the present invention. Fibers 88 containing aromatic fluids or herbal medicines may be filled in the cavity of the ball 84 created by the bores 72 of each upper part 34. Stops 90 may be used to plug the openings 70 if desired. The aroma or fragrance emitted by the fibers 88 enhance the massaging effect. The ball 84 can be used in the same manner as the cap 24 to administer massage, or it can be rotated or rubbed between the palms of the hands, as shown in FIG. 12, during which fragrance may be emitted through the openings 70. The symmetrical configuration of the ball 84 allows the ball 84 be rubbed and turned around between the two hands without being dropped. This type of rotation creates a different wave pattern on the skin during massage.

Third, referring to FIG. 13, the lower part 36 of the cap 24 has a symmetrical and balanced configuration which allows it to be used as a spinning toy by spinning the tip 60 on a flat surface.

While the description above refers to particular embodiments of the present invention, it will be understood that many modifications may be made without departing from the spirit thereof.

What is claimed is:

1. A bottle and cap combination comprising:

a bottle for containing contents, the bottle comprising a neck with an opening through which the contents may flow, and a bottom;

a cap secured to the neck of the bottle, the cap having means in flow communication with the neck opening for controlling the flow of the contents through the cap, and means for securing the cap to the neck of the bottle;

first massaging means provided on the cap; and second massaging means provided on the bottom of the bottle.

2. The combination of claim 1, wherein the cap comprises a lower part and an upper part coupled to the lower part.

3. The combination of claim 2, wherein the first massaging means comprises a plurality of curved outer surfaces formed on the upper part and forming a tip at an upper portion of the upper part.

4. The combination of claim 3, wherein the curved surfaces extend from a lower portion of the upper part, where the curved surfaces are thicker and broader, to the upper portion of the upper part, where the curved surfaces are thinner and sharper.

5. The combination of claim 1, wherein the second massaging means comprises a plurality of rounded protrusions spaced apart on the bottom of the bottle.

6. The combination of claim 5, wherein the plurality of rounded protrusions are smaller near the center of the bottom of the bottle.

7. The combination of claim 2, wherein the lower part comprises a central bore communicating with a channel through a channel opening, and a shaft having a plurality of spokes disposed within the channel opening and defining a plurality of apertures, the shaft having a narrowed tip at its upper end, wherein the contents from the central bore may flow through the plurality of apertures into the channel.

8. The combination of claim 7, wherein the lower part further comprises an annular upturn defining a well for collecting the contents.

9. The combination of claim 8, wherein the upper part comprises a hollow interior and a bore defined therewithin, the first massaging means further comprising a plurality of curved surfaces formed on the outer surface of the upper part and forming a tip at an upper portion of the upper part, the tip of the upper part provided with an upper part tip opening communicating with the bore of the upper part, wherein the narrowed tip of the shaft is adapted to be fitted in the upper part tip opening to seal the upper part tip opening, and wherein a circumferential mouth of the channel abuts an inner wall of the bore of the upper part to prevent the contents from escaping from the bore of the upper part.

10. The combination of claim 9, further comprising means for attaching the upper part to the lower part.

11. The combination of claim 7, wherein the means for securing comprises a plurality of threads provided on the neck for threaded engagement with threads provided on the interior of the central bore of the lower part.

12. The combination of claim 2, wherein the first massaging means comprises a plurality of curved outer surfaces formed on the upper part and forming a tip at an upper portion of the upper part, and the curved surfaces extending from a lower portion of the upper part, where the curved surfaces are thicker and broader, to the upper portion of the upper part, where the curved surfaces are thinner and sharper; and wherein the second massaging means comprises a plurality of rounded protrusions spaced apart on the bottom of the bottle, and wherein the plurality of rounded protrusions are smaller near the center of the bottom of the bottle.

* * * * *